United States Patent [19]

Mugrauer et al.

[11] Patent Number: 4,465,357

[45] Date of Patent: Aug. 14, 1984

[54] DRIVE SYSTEM FOR A PHOTOCOPIER

[75] Inventors: Hubert Mugrauer, Poering; Walter Kopp, Taufkirchen, both of Fed. Rep. of Germany

[73] Assignee: Siemens Aktiengesellschaft, Berlin & Munich, Fed. Rep. of Germany

[21] Appl. No.: 366,341

[22] Filed: Apr. 7, 1982

[30] Foreign Application Priority Data

Apr. 30, 1981 [DE] Fed. Rep. of Germany ..... 3117278

[51] Int. Cl.[3] ..... G03G 15/00

[52] U.S. Cl. ..... 355/3 R; 355/11

[58] Field of Search ..... 355/3 R, 8, 11, 66; 346/153.1; 358/300; 74/664, 665 G, 665 GA; 474/86, 148, 149

[56] References Cited

U.S. PATENT DOCUMENTS

| | | | |
|---|---|---|---|
| 3,148,601 | 9/1964 | Trumbull | 355/11 |
| 3,399,610 | 9/1968 | Eichorn | 355/8 |
| 3,736,053 | 5/1973 | Shreeve et al. | 355/3 R |
| 4,124,288 | 11/1978 | Zeuthen | 355/3 R X |
| 4,299,473 | 11/1981 | Endo | 355/8 X |

FOREIGN PATENT DOCUMENTS

| | | | |
|---|---|---|---|
| 53-19837 | 2/1978 | Japan | 355/3 R |

*Primary Examiner*—J. V. Truhe
*Assistant Examiner*—J. Pendegrass
*Attorney, Agent, or Firm*—Hill, Van Santen, Steadman & Simpson

[57] ABSTRACT

A central drive system for a nonmechanical printing or copying device such as a photocopier has a central drive system with one motor which is subdivided into a main drive system with high precision for driving elements requiring a high degree of synchronization and a subsystem with less precision for driving elements requiring a lesser degree of synchronization. The main drive system drives the photoconductor drum, the slide scanning roller and a feed crawler in the paper transport unit. The subsystem drives a cleaning brush, the developer roller and mixing screws in the developer station.

10 Claims, 5 Drawing Figures

$$\Delta L = -d_o \times \tan\left(90° - \frac{\varepsilon}{2}\right) + 2\sqrt{\frac{d_o^2}{4} \times \tan^2\left(90° - \frac{\varepsilon}{2}\right) + d_o \times 2e \times \sin\left(90° - \frac{\varepsilon}{2}\right) + 4e^2} = \overline{AA'}$$

$$\omega_{max} = \frac{v_o}{\frac{d_o}{2} - e}$$

$$\omega_{min} = \frac{v_o}{\frac{d_o}{2} + e}$$

$l = \overline{A_1 A_2}$
$\Delta f = f_{max} - f_{min}$
$\Delta f = l(\tan\alpha_{max} - \tan\alpha_{min})$
PHKR
AKR1
KSP1
AK1
DKR
$A_1$
$A_2$
K
$f_{min}$
$f_{max}$
$\alpha_{min}$
$\alpha_{max}$
l
$f_K$
KL

DRIVE SYSTEM FOR A PHOTOCOPIER

BACKGROUND OF THE INVENTION

1. Field of the Invention

The present invention relates to nonmechanical printing or copying devices operating according to electrophotographic principles, and in particular to a drive system for such a device.

2. Description of the Prior Art

In conventional data printers and copying devices operating according to principles of electrophotography, the various rotating or moving elements of such devices are respectively driven with separate motors and gears which are synchronized by means of a complicated and costly electronic monitoring system. The high cost is due not only to the necessity of an electronic monitoring system, but is also a result of the several duplicate motors which are required.

SUMMARY OF THE INVENTION

It is an object of the present invention to provide a drive system for driving the various elements of a nonmechanical printing or copying device such that a high degree of synchronization can be attained with a significantly decreased material outlay.

The above object is inventively achieved in a nonmechanical printing or copying device such as a photocopier wherein substantially all of the movable elements of the device are driven by a central drive system.

In a further embodiment of the invention, the central drive system is subdivided into a main drive system with high precision for driving the photoconductor drum, the slide scanning roller of the preprinting station and the paper transport unit and a subsystem with lesser precision for driving the cleaning brush, the developer roller, and the developer mixing screws.

DESCRIPTION OF THE PREFERRED EMBODIMENTS

Figure 1:
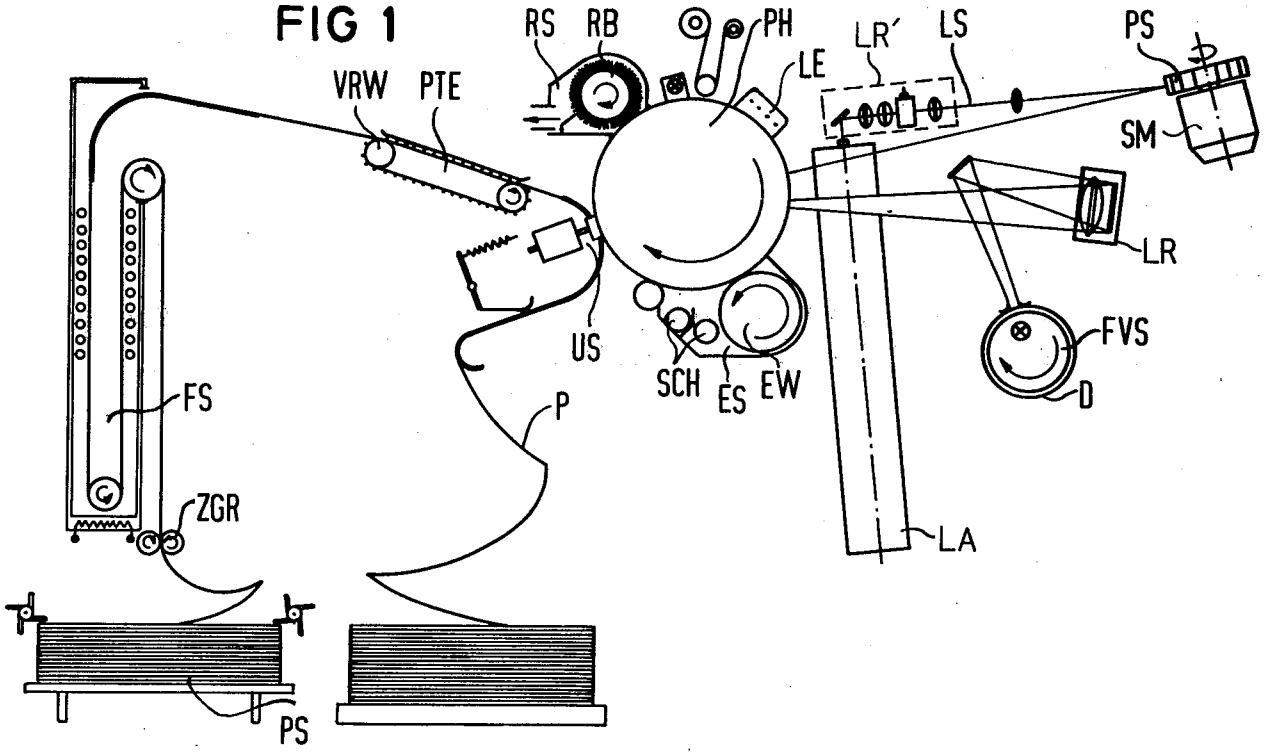
FIG. 1 is a schematic representation of a printing or copying device operating by electrophotographic principles in which the central drive system disclosed herein may be utilized.

A typical printing or copying device according to electrophotographic principles in which the drive system disclosed and claimed herein may be utilized is schematically represented in FIG. 1. The photocopier includes a charging device LE by means of which a charge is applied to the surface of a photoconductor drum PH. A latent charge image is generated on the surface of the drum PH by means of light, which may be provided by a laser LA or a preprinting station FVS. If the light is provided by a laser LA, the laser beam LS passes through a lens system LR′ and is directed by a multi-faced mirror PS rotated by a mirror motor SM to the surface of the drum PH. If the light is provided by the preprinting station FVS, the light is reflected from a slide scanning drum D through a lens system LR to the surface of the drum PH.

The individual latent charge images are inked in a developer station ES including a developer roller EW and a plurality of developer mixing screws SCH wherein toner powder is applied. The toner image leaves the developer station ES and is transferred to normal paper P in a transferring station US. The paper P is moved past the photoconductor drum surface tangentially by means of a paper transport unit PTE which includes a crawler with a crawler shaft VRW.

The paper P is drawn out of the paper transport unit PTE by means of pulling rollers ZGR and through a fixer station FS which permanently fixes the toner image on the paper P. The paper is then deposited in a paper stacking device PS.

After the toner image has been transferred to the paper P, any residual toner is brushed off of the surface of the photoconductor drum PH by a cleaning brush RB which is provided in a cleaning station RS, and the excess toner is suctioned off into a filter system.

Figure 2:
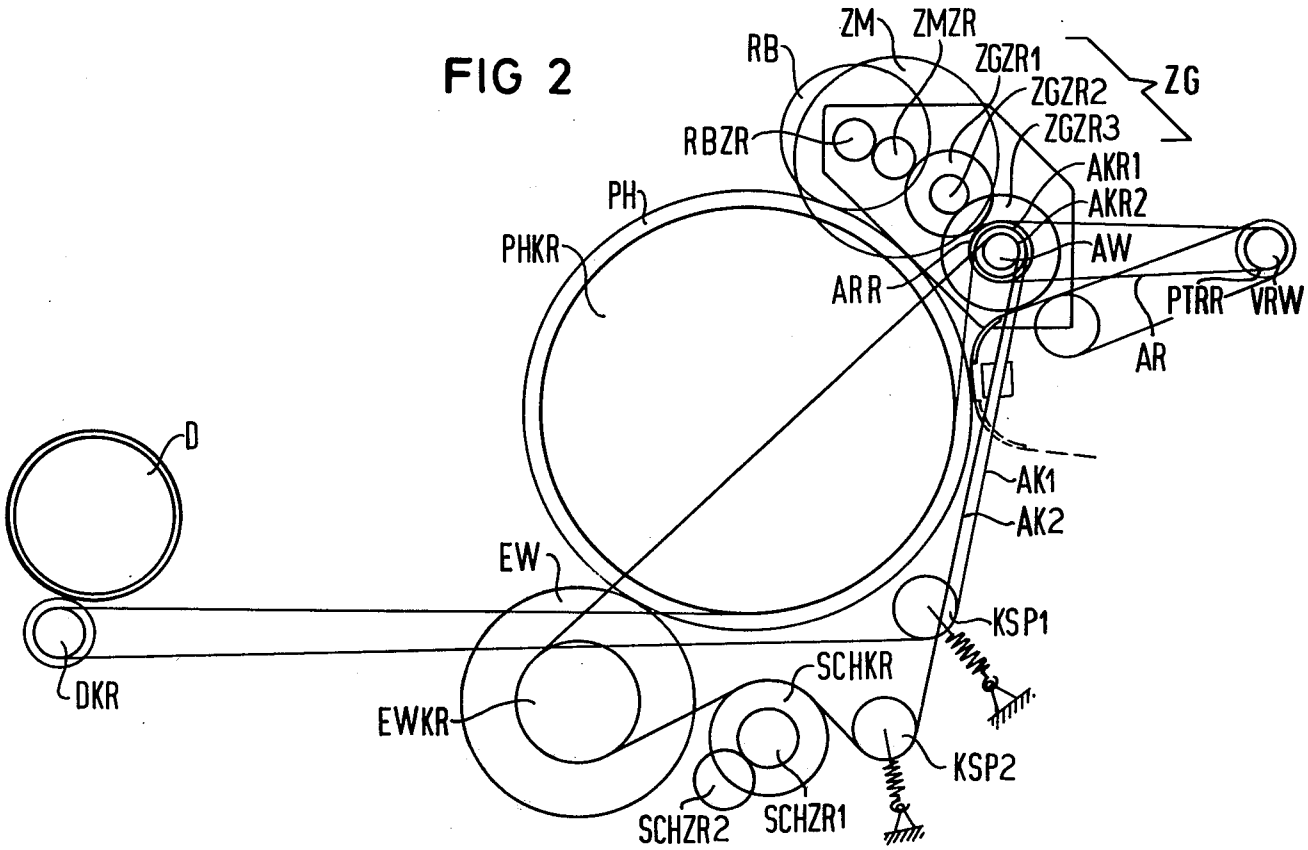
FIG. 2 is a schematic representation of a central drive system for a photocopier constructed in accordance with the principles of the present invention.

In accordance with the principles of the present invention, a central drive system as shown in FIG. 2 is provided whereby substantially all of the moving components of the photocopier shown in FIG. 1 are driven with a precise synchronization. Specifically, the central drive system shown in FIG. 2 drives the photoconductor drum PH, the paper transport unit PTE, the slide scanning roller D, the preprinting station FVS, the developer roller EW, the developer mixing screws SCH, and the cleaning brush RB.

The central drive system shown in FIG. 2 has a central motor ZM and is divided into a main drive system with high precision and a subsystem having less precision. The photoconductor drum PH, the slide scanning roller D and the paper transport unit PTE are driven with high precision and the cleaning brush RB, the developer roller EW and the developer mixing screws SCH are driven with lesser precision.

For reasons of positioning, the cleaning brush RB and the paper transport unit PTE are driven with separate elements. The cleaning brush RB has a cleaning brush gear RBZR which is disposed coaxially with the brush RB on a shaft. The cleaning brush gear RBZR is driven directly by a gear ZMZR which is attached to the drive shaft of the central motor ZM. Such direct drive is possible because the central motor ZM operates at approximately 1500 RPM, which corresponds approximately to the desired rotational speed for the cleaning brush RB. For the remaining movable elements, the speed of rotation of the central motor ZM must be reduced by a factor of 6. This speed reduction is accomplished by means of a two stage intermediate gear train ZG having component gears ZGZR1, ZGZR2 and ZGZR3. The gears ZGZR1 and ZGZR2 have different diameters and are mounted on the same shaft, and the third gear ZGZR3 in the gear train ZG is mounted on a separate jack shaft AW by means of which all of the remaining movable elements are driven by chains, tooth belts and the like. The shaft AW also has two drive chain wheels AKR1 and AKR2 and a belt pulley ARR mounted thereon.

The belt pulley ARR drives the feed crawler shaft VRW of the paper transport unit PTE by means of a continuous toothed belt AR which wraps the belt pulley ARR and a gear PTRR mounted on the shaft VRW. The toothed belt AR is appropriately stretched around the shaft AW by turning the cleaning brush RB which causes the gear train ZG to operate. The relationship between the central motor gear ZMZR to the remaining gears does not change because the central motor ZM is fastened in fixed relation to the gear train ZG.

The photoconductor drum PH is driven by a chain AK1 which is trained about the first chain wheel AKR1 on the shaft AW and a chain wheel DKR which is attached to a shaft engaging the slide scanning roller D for rotation thereof. The chain AK1 engages a photoconductor drum chain wheel PHKR for rotating the drum PH. The loose stringer of the chain AK1 is tensioned by a chain tightener KSP1, having a suitable bias means such as a spring.

A second chain AK2 is trained about the second chain wheel AKR2 on the shaft AW and a developer roller chain wheel EWKR for driving the developer roller EW. The second chain AK2 also engages a developer mixing screw chain wheel SCHKR. The developer mixing screw chain wheel SCHKR has a gear SCHZR1 for driving a first developer screw which is in engagement with a gear SCHZR2 for driving a second developer screw. The loose stringer of the second chain AKR wraps a second chain tightener KSP2 which also has a suitable bias means, such as a spring.

An important factor for precisely positioning the image generated by the computer-controlled laser beam or by the preprinting station FVS is the continuity of the angular velocity of the feed crawler drive shaft VRW, the photoconductor drum PH, and the slide scanning roller D. In order to attain an angular velocity of sufficient constancy for these elements, certain conditions must be fulfilled. First, the angular velocity of the output drive shaft of the central motor ZM must be maintained constant. This is achieved by the use of a synchronous motor running with standard mains frequency. Secondly, the angular velocity reduction achieved by the intermediate gear train ZG must be precise. This required precision can be attained with gears which are manufactured according to the gear hobbing system.

It is also necessary to maintain the effect of pitch errors between the orientation of the gear ARR and the gear PTRR wrapped by the belt AR as small as possible. This can be achieved by making the length of the belt AR as small as possible, because the pitch error between respective teeth of the gears ARR and PTRR which are close to one another is less than the pitch error of similar teeth which are disposed far apart.

Similar considerations apply to those elements driven by the first drive chain AK1 wherein the pitch error among the photoconductor drum gear PHKR, the slide scanning roller gear DKR, the drive gear AKR1, the gear ARR and the paper transport gear PTRR. This small pitch error is also minimized by manufacturing the gears by the gear hobbing system.

Small radial deviations among the gears and wheels identified above must also be minimized in order to maintain the angular velocity of these gears and the chains or belts driven thereby relatively constant. In this regard, several equations can be developed to calculate such potential deviations. A radial deviation in the gear AKR1 results in a velocity fluctuation of the first drive chain AK1 thereby resulting in respective velocity fluctuations $\Delta\omega_{PHKR}$ and $\Delta\omega_{DKR}$ in the gears PHKR and DKR according to the equations $$\Delta\omega_{PHKR} = \frac{2\omega_{AKR1} \cdot \Delta r_{AKR1}}{r_{PHKR}}$$

$$\Delta\omega_{DKR} = \frac{2\omega_{AKR1} \cdot \Delta r_{AKR1}}{r_{DKR}}$$

wherein $\omega_{AKR1}$ equals the angular velocity of the gear AKR1, $\Delta r_{AKR1}$ equal the radial deviation of the drive gear AKR1, $r_{PHKR}$ equals the radius of the photoconductor drum gear PHKR, and $r_{DKR}$ equals the radius of the slide scanning roller gear DKR.

A radial deviation of the gear PHKR results in an angular velocity fluctuation $\Delta\omega_{PHKR}$ in the angular velocity of the gear PHKR according to the equation $$\Delta\omega_{PHKR} = \frac{2v_o \cdot \Delta r_{PHKR}}{r^2_{PHKR} - r^2_{PHKR}}$$

wherein $v_o$ equals the chain velocity of the drive chain AK1.

A radial deviation of the gear DKR results in an angular velocity fluctuation $\Delta\omega_{DKR}$ of the gear DKR according to the equation $$\Delta\omega_{DKR} = v_o \cdot \frac{2\Delta r_{DKR}}{r^2_{DKR} - \Delta r^2_{DKR}}$$

wherein $\Delta r_{DKR}$ equals the radial deviation of the gear DKR and $r_{DKR}$ equals the radius of the gear DKR.

Figure 3:
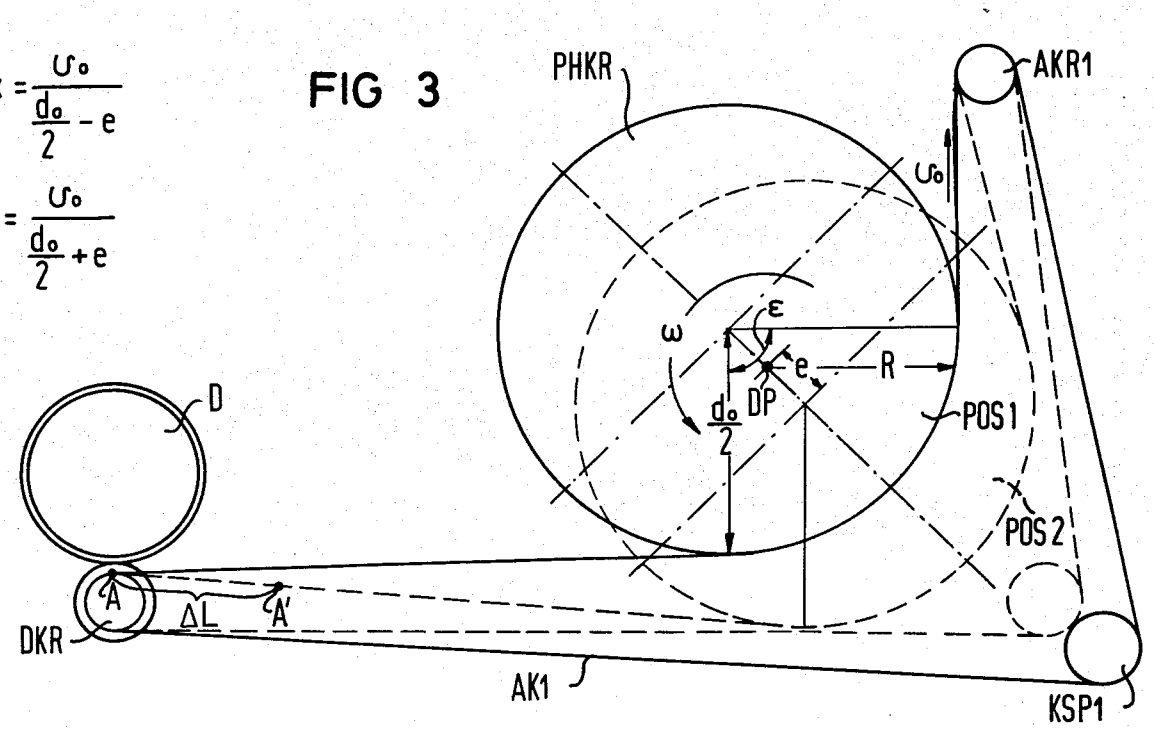
FIG. 3 is a schematic representation showing the influence of radial deviation of the photoconductor drum chain wheel on the chain velocity and angular velocity of the chain wheels in the drive system shown in FIG. 2.

Another factor affecting the precision with which the driven elements are rotated is the looping angle or grip angle $\epsilon$ of the chain AK1 around the photoconductor drum gear PHKR. The radial deviation of the photoconductor drum gear PHKR further has an effect upon the angular velocity of the slide scanning roller gear DKR which is also dependent upon the looping angle $\epsilon$ around the gear PKHR. These effects are illustrated in FIG. 3 wherein the two extreme positions of the photoconductor drum gear PHKR caused by an eccentricity e are shown with a fulcrum point DP and a radius $D_o/2$. The variable effective radius, which is dependent upon the eccentricity e, and which determines the angular velocity $\omega$ of the gear PHKR is represented by R in FIG. 3. If the gear PHKR moves from position POS1, shown in solid lines, to position POS2 shown in dashed lines, the portion of the chain AK1 between the two gears PHKR and DKR is moved by a length $\Delta L$ which is equal to the distance between $\overline{AA'}$ because the gear AKR1 produces a constant chain velocity $v_o$. This additional movement, because the total chain length is constant, is equalized by the chain tightener KSP1. This means that the additional movement is completely transmitted to the gear DKR, so that a relative velocity between the surface of the slide scanning roller D and the surface of the photoconductor drum PH arises which results in transmission errors. As is apparent from the equation for $\Delta L$ (which equals the length $\overline{AA'}$) shown in FIG. 5, $\Delta L$ is influenced by the looping angle $\epsilon$ and by the eccentricity e independently of one another. This means, for example, in the case in which $\epsilon$ and e approach 0, ΔL also approaches 0. The photoconductor drum PH, the mounting means for the drum PH (not shown), and the drum gear PHKR have a significant moment of inertia during acceleration so that in practice a looping angle ϵ which is equal to 0° cannot be realized, so that it is not possible to completely eliminate ΔL in practice. An optimum of precision and security results with a looping angle ϵ which is equal to approximately 30°. Expressions for the maximum angular velocity $\omega_{max}$ of the drum PHKR and the minimum angular velocity $\omega_{min}$ of the drum gear PHKR are also represented in FIG. 3.

The use of a second drive chain AK2 for driving the cleaning brush RB, the developer roller EW and the two mixing screws SCH permits those elements to be driven with less precision than those elements driven with a higher precision by the first drive chain AK1. In the main drive system associated with the drive chain AK1, only the drum gear PHKR for the photoconductor drum PH and the gear DKR for the slide scanning roller D are gears or toothed wheels. Because the radial deviation as well as the looping angle of the chain on such gears or toothed wheels negatively influence the angular velocity constancy of the driven gears or toothed wheels, the number of such gears and toothed wheels in the main drive system has been kept to a minimum in order to achieve the desired high precision. In the subsystem driven by the second drive chain AK2, the gear EWKR for the developer roller EW and the two gears SCHZR1 and SCHZR2 for the mixing screws are driven by the second drive chain AK2, thereby resulting in less precision, however, these driven elements do not require the same high precision as the elements driven by the chain AK1 in the main system.

Figures 4, 4A:
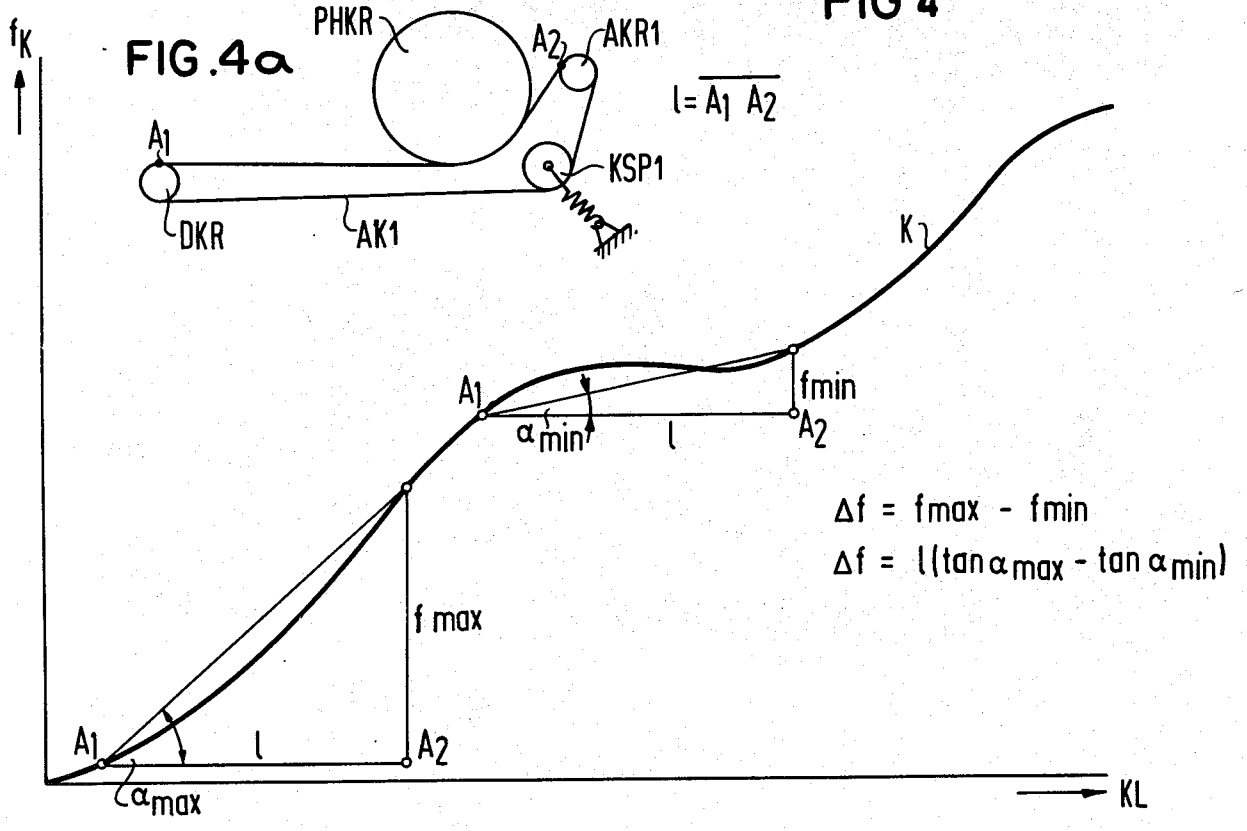
FIG. 4 is a schamatic representation of the influence of the pitch error of a drive chain on the precision of the drive system disclosed herein.
FIG. 4*a* is a schematic representation of those elements of FIG. 2 which play a part in developing the graph shown in FIG. 4.

As stated above, the precision with which a driven element can be rotated is dependent upon the length of the chain or belt which is used to drive the element, with a shorter chain or belt resulting in a higher precision. In order that the surface speeds of the photoconductor drum PH and the slide scanning roller D remain constant at all times, the pitch error of the chain AK1 must be constant. This means that ideally when the drive gear AKR1 advances the chain AK1 by an incremental distance, the chain AK1 which is at that point in time in the vicinity of the gears PHKR and DKR should also be advanced by the same incremental distance. In practice, however, a perfect chain which is constant in pitch cannot be achieved and therefore the precision of the drive system is increased when the chain length between the precisely driven gears PHKR and DKR is maintained as small as possible. A polar frequency response locus for that portion of the drive system shown in FIG. 4*a* is shown in FIG. 4, wherein the deviation of the chain length from a theoretical size is represented on the ordinate as $f_K$ and the actual chain length KL is represented on the abscissa. Because the chain moves continuously, each partial section of the chain comes between points $A_1$ and $A_2$. If one now moves a distance 1, which is equal to $\overline{A_1A_2}$ along the chain length (abscissa), pitch errors $f_{max}$ and $f_{min}$ occur between the points $A_1$ and $A_2$. If $f_{max}$ is equal to $f_{min}$, the curve K represents a straight line and no rotational speed changes of the gears PHKR and DKR would occur. In practice this ideal case does not occur, and the following errors therefore result:

$$\Delta f = f_{max} - f_{min}$$

$$\Delta f = l(\tan \alpha_{max} - \tan \alpha_{min})$$

wherein l is equal to $\overline{A_1A_2}$ and $\alpha_{max}$ and $\alpha_{min}$ are the angles developed as shown in FIG. 4. From the second equation for Δf above, one can see that Δf is smaller when the distance between the points $A_1$ and $A_2$ is made smaller.

Additional synchronization is necessary to attain the precision needed for printing continuous forms. In particular, the laser printing must be synchronized with the transport of the forms. As described above, the line sequence for printing by means of the laser LA is controlled by means of a multi-faced polygonal mirror PS driven by a synchronous motor SM (see FIG. 1). The paper transport unit PTE is also driven by a synchronous motor, namely the central motor ZM. The necessary synchronization and precision is attained by operating the synchronous motor SM with clock pulses generated by any suitable pulse generating means attached to the shaft of the central motor ZM. If form printing is undertaken utilizing the slide scanner roller D, synchronization with the paper transport unit PTE is achieved via the drive chain AK1 or the belt AR as described above. Laser printing and form printing generated by the slide scanner roller D are synchronized by the above synchronization means.

Because the paper transport unit PTE is disposed after the transfer station US, the surface speed of the photoconductor drum PH must be slightly less than the velocity of the paper P such as, for example, approximately 2 to 4 mils less. This assures that the paper P is not transported more quickly from the photoconductor drum PH, caused by electrostatic forces between the paper and the photoconductor drum, than by the feed crawler.

Although modifications and changes may be suggested by those skilled in the art it is the intention of the inventors to embody within the patent warranted hereon all changes and modifications as reasonably and properly come within the scope of their contribution to the art.

We claim as our invention:

1. In a nonmechanical printing or copying device operating according to electrophotographic principles having a rotating photoconductor drum for intermediate storage of a latent charge image on the surface thereof, a means including a revolving slide scanning roller for directing a light beam onto said photoconductor drum surface for generating said latent charge image, a developer station having a rotating developer roller and a plurality of rotating mixing screws for applying toner powder to said latent charge image, a transfer station for transferring said image to paper having a transport unit for moving said paper, and a cleaning station having a rotating cleaning brush for removing excess toner from said photoconductor drum surface after transfer of said image to the paper, the improvement comprising:

a central drive system having a drive motor in driving engagement with each of said photoconductor drum, said slide scanning roller, said developer roller, said mixing screws, said paper transport unit and said cleaning brush for rotation thereof; and said central drive system being subdivided into a main drive system for driving said photoconductor drum, said slide scanning roller, and said paper transport unit with a precise degree of synchronization among said drum, scanning roller and transport unit, and a subsystem for driving said cleaning brush, said developer roller and said mixing screws with a lower degree of synchronization among said brush, developer roller, and mixing screws.

2. The improvement of claim 1 wherein said central drive system further comprises:

a drive gear mounted on a drive shaft of said motor; and an intermediate reduction gear train in driving engagement with said drive gear, said gear train having a last gear mounted on a jack shaft;

and wherein said main drive system comprises:

at least one additional gear mounted on said jack shaft; and a means for drivingly engaging said additional gear with at least said photoconductor drum and said slide scanning roller.

3. The improvement of claim 2 wherein said means for drivingly engaging said additional gear comprises:

a photoconductor drum gear corotationally mounted on said photoconductor drum;

a slide scanning roller gear corotationally mounted on said slide scanning roller; and a continuous main drive chain trained about said additional gear, said photoconductor drum gear and said slide scanning roller gear for driving thereof.

4. The improvement of claim 3 wherein said main drive chain is trained about a portion of said photoconductor drum gear forming a looping angle and wherein said looping angle is selected for minimizing any change in the length of said main drive chain between said photoconductor drum gear and said slide scanning roller gear which results from off-center movement of said photoconductor drum gear.

5. The improvement of claim 4 wherein said looping angle is less than 30°.

6. The improvement of claim 3 wherein the distances between said photoconductor drum gear and said additional gear and between said slide scanning roller gear and said additional gear are selected to be a minimum.

7. The improvement of claim 2 wherein said subsystem comprises:

a second additional gear mounted on said jack shaft;

a developer roller gear corotationally mounted on said developer roller;

a mixing screw gear corotationally mounted on one of said mixing screws; and a continuous subsystem drive chain trained about said second additional gear, said developer roller gear and said mixing screw gear for driving thereof.

8. The improvement of claim 7 further comprising:

an additional mixing screw gear corotationally mounted on said one of said mixing screws and at least a further mixing screw gear mounted on another of said mixing screws in driving engagement with said additional mixing screw gear for rotating another of said plurality of mixing screws.

9. The improvement of claim 2 wherein said paper transport unit includes a feed crawler with a feed crawler shaft and wherein said main drive system further comprises a further gear mounted on said jack shaft and a continuous toothed belt trained about said feed crawler shaft and said further gear for driving said feed crawler.

10. The improvement of claim 2 wherein said subsystem includes a cleaning brush gear corotationally mounted on said cleaning brush in direct driving engagement with said drive gear of said motor.

* * * * *